US006394683B1

(12) United States Patent
Pao

(10) Patent No.: US 6,394,683 B1
(45) Date of Patent: May 28, 2002

(54) FLOOR MOP WITH PRESSURIZED SPRAYER

(76) Inventor: Edward Pao, 1640-A Kalama St., Wailuku, HI (US) 96793

( * ) Notice: Subject to any disclaimer, the term of this patent is extended or adjusted under 35 U.S.C. 154(b) by 0 days.

(21) Appl. No.: 09/772,720

(22) Filed: Jan. 30, 2001

(51) Int. Cl.[7] ..... A47L 13/22

(52) U.S. Cl. ..... 401/289; 401/6; 401/137; 401/188 R

(58) Field of Search ..... 401/6, 137, 138, 401/140, 188 R, 190, 289; 15/327.5; 417/234

(56) References Cited

U.S. PATENT DOCUMENTS

| | | | |
|---|---|---|---|
| 863,220 A | 8/1907 | Quimby | |
| 927,872 A | 7/1909 | Price | |
| 2,609,557 A | 9/1952 | Reed | |
| 3,457,016 A | 7/1969 | Gotberg | |
| 4,152,084 A | 5/1979 | Melton et al. | |
| 4,971,471 A | 11/1990 | Sloan | |
| 6,006,400 A * | 12/1999 | Presenza | 15/327.5 |

* cited by examiner

*Primary Examiner*—David J. Walczak
*Assistant Examiner*—Peter deVore
(74) *Attorney, Agent, or Firm*—Jack Lo

(57) ABSTRACT

The present mop is comprised of a head attached to the lower end of a long handle. The head is narrow enough to be moved in a figure "8" pattern. Flexible rayon cords are attached to the head for proper absorbency and texture to avoid streaking. A backpack tank holding a solution is connected by a tube to a sprayer nozzle outside the head for evenly applying the solution on a floor. The tank is pressurized by a pressurizing pump which is operated by a pivoting lever projecting in front of the tank. The lever is positioned at waist level so that it is operable by the worker while the tank is worn. A sprayer control valve is attached along the tube on the handle to control spraying. The valve is offset about 90 degrees relative to the nozzle about the axis of the handle for easy reach.

6 Claims, 2 Drawing Sheets

FLOOR MOP WITH PRESSURIZED SPRAYER

BACKGROUND OF THE INVENTION

1. Field of the Invention

This invention relates generally to mops for cleaning and waxing floors.

2. Prior Art

Most hard floors in commercial spaces such as retail stores and business offices are waxed periodically. The simplest and most commonly used method is comprised of filling a bucket with a wax solution, dipping a mop into the solution, and spreading the solution on the floor by moving the mop in a figure "8" pattern. The primary drawback of this method is that a lot of solution is initially put down by the dripping wet mop after dipping, but as the solution is spread out by the mop, it is gradually thinned out until the next dip. The resulting coating is uneven and tends to be thicker than necessary at some areas and too thin at other areas. Since the bucket is left on the floor, the worker would get farther and farther away as the mopping progresses, and has to walk back over the wet floor to dip the mop or to move the bucket closer. If the mop is used on a dirty floor, the solution would get dirty when the mop is dipped into it. The thicker parts of the uneven wax coating take longer to dry and remain very slippery when still wet.

Various other mops are known among the prior art. One disclosed in U.S. Pat. No. 4,971,471 to Sloan is comprised of a rigid head on the end of a long handle. The head is wrapped in an absorbent material and fed with a solution from a backpack tank. The flow of solution is controlled by a simple clamp along a tube between the tank and the head. However, the mop does not lay down enough solution because the head is simply gravity fed. The absorbent material is also too small for waxing large commercial spaces.

A mop disclosed in U.S. Pat. No. 4,152,084 to Melton et al. is comprised of a very wide rigid head with a cotton wick. The solution is fed through the head by a pressurized backpack tank. However, the plunger pump handle cannot be operated while the tank is worn on the worker, so that the tank must be taken off periodically to be pressurized again. The head is so wide that it cannot be moved in the figure "8" pattern. The flow of the solution is also restricted by the cotton wick. Further, the cotton wick is too absorbent for waxing floors.

A mop disclosed in U.S. Pat. No. 3,457,016 to Gotberg is comprised of a rigid mop head on a long handle. A pressurized solution tank is attached to the lower end of the handle. Sprayer nozzles under the handle are controlled by a control lever under a grip at the top end of the handle. Due to the weight of the tank on the head and the position of the control lever, the mop is limited to being pushed in front of the worker like a vacuum cleaner. The mop cannot wax the floor evenly with such a motion. Another mop disclosed in U.S. Pat. No. 863,220 to Quimby is comprised of a solution tank pivotally attached to a mop head. The tank is tipped over to pour out the solution, but the flow rate is difficult to control, and the coverage is not as even as a sprayer. A hand broom disclosed in U.S. Pat. No. 2,609,557 to Reed is comprised of a broom brush with a sprayer, but the brush bristles are too stiff for waxing floors. A paint applicator shown in U.S. Pat. No. 927,872 to Price is comprised of a paint brush fed by a pressurized backpack tank, but the plunger pump handle cannot be operated while the tank is worn.

OBJECTIVES OF THE INVENTION

Accordingly, the objectives of the present floor mop are:

- to apply a wax solution to a hard floor evenly for economy and faster drying;
- to apply the solution quickly;
- to be easily movable in a figure "8" pattern to spread the solution;
- to carry the solution in a backpack tank for convenience;
- to have the tank pressurized for feeding the solution quickly;
- to have a pressurization pump which is operable while the tank is worn; and
- to have a sprayer control valve which is easily operable while moving the mop in the Figure "8" pattern.

Further objectives of the present invention will become apparent from a consideration of the drawings and ensuing description.

BRIEF SUMMARY OF THE INVENTION

The present mop is comprised of a head attached to the lower end of a long handle. The head is narrow enough to be moved in a figure "8" pattern. Flexible rayon cords are attached to the head for proper absorbency and texture to avoid streaking. A backpack tank holding a solution is connected by a tube to a sprayer nozzle outside the head for evenly applying the solution on a floor. The tank is pressurized by a pressurizing pump which is operated by a pivoting lever projecting in front of the tank. The lever is positioned at waist level so that it is operable by the worker while the tank is worn. A sprayer control valve is attached along the tube on the handle to control spraying. The valve is offset about 90 degrees relative to the nozzle about the axis of the handle for easy reach.

Figure 1:
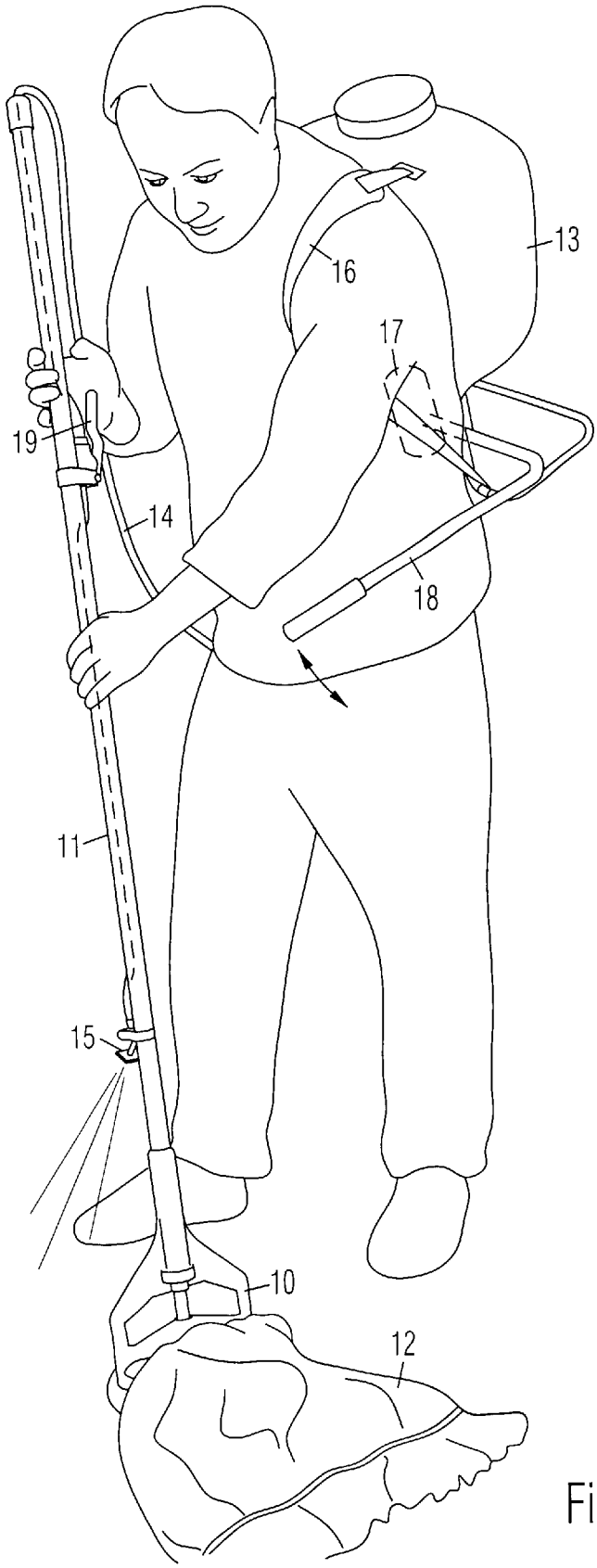
FIG. 1 is a front perspective view of the present mop being used.

| DRAWING REFERENCE NUMERALS | |
|---|---|
| 10. Head | 11. Handle |
| 12. Absorbent Material | 13. Tank |
| 14. Tube | 15. Sprayer Nozzle |
| 16. Straps | 17. Pump |
| 18. Pump Lever | 19. Sprayer Valve |

DETAILED DESCRIPTION OF THE INVENTION

Figure 2:
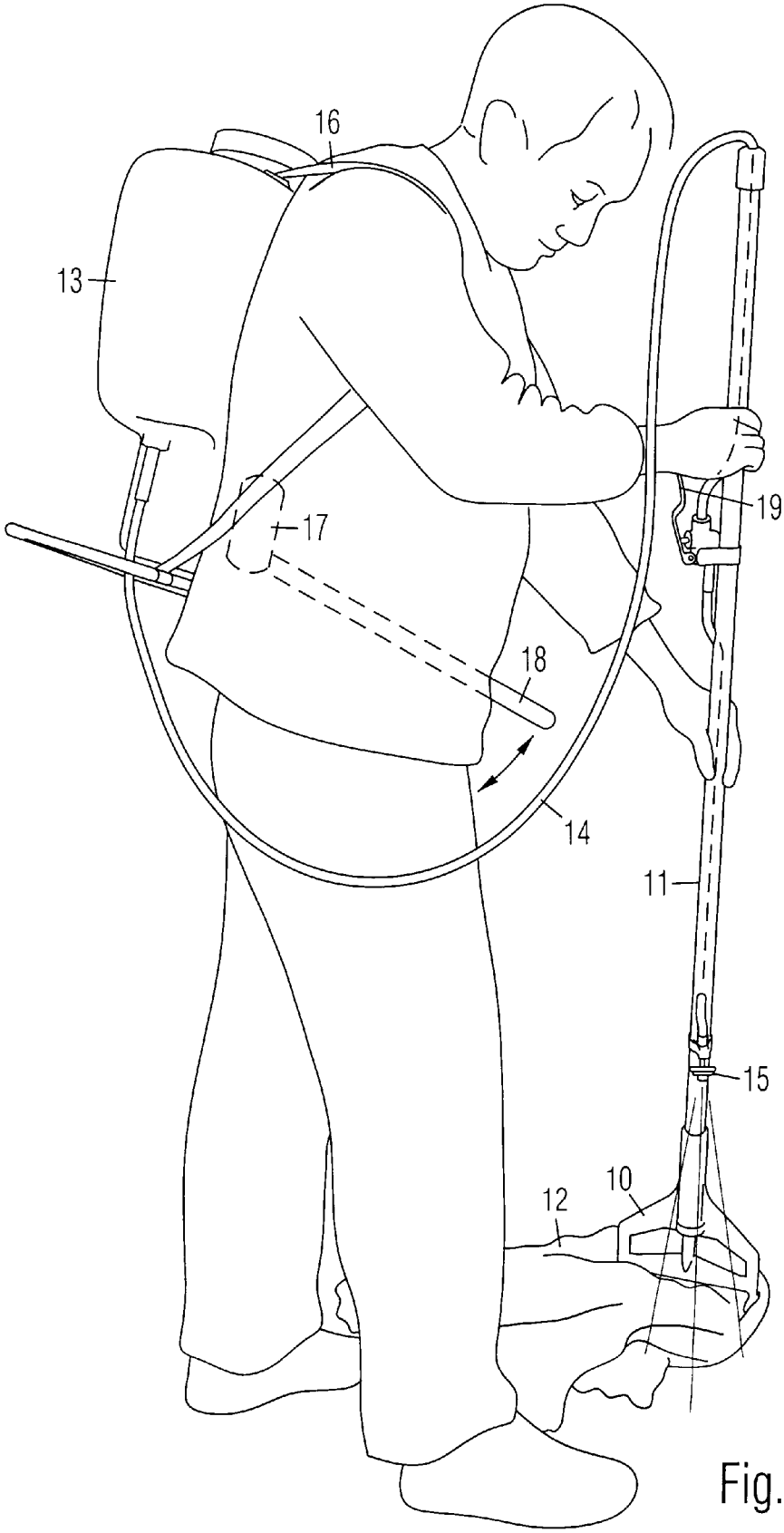
FIG. 2 is a side perspective view thereof.

A preferred embodiment of the present mop for waxing floors is shown in FIGS. 1 and 2. It is comprised of a head 10 attached to the lower end of a long handle 11. Head 10 may be of any suitable shape. A resilient absorbent material 12, which is preferably a loose bundle of flexible cords, is attached to head 10 for absorbing and spreading a suitable wax solution. Alternatively, absorbent material 12 may be attached directly to the lower end of handle 11 without head 10. Absorbent material 12 is preferably rayon for proper absorbency and texture to avoid streaking. Head 10 is preferably less than about 10 inches across for being easily moved in a figure "8" pattern for quickly spreading the solution. A backpack tank 13 holding an ample supply of the solution is connected by a tube 14 to a nozzle 15 which is preferably outside head 10. Nozzle 15 is attached at a suitable angle to handle 11 above and outside of head 10 for spraying the solution on the floor beside cords 12. Since nozzle 15 is outside head 10, the flow of the solution is not impeded by absorbent material 12. Straps 16 attached to tank 13 enable it to be carried on the back of a worker. Tank 13 is pressurized by a pressurizing pump 17 positioned therein to deliver the solution under a high enough pressure for spraying, and to spray the solution quickly enough for rapid waxing.

Since the pressure in tank 13 is gradually reduced as the solution level is lowered during waxing, pump 17 is operated to increase the pressure as necessary by moving up and down a pivoting pump lever 18 attached to a side of tank 13. Pump lever 18 is positioned adjacent a lower end of tank 13 and directed forwards for being at the side of the worker at about waist level, so that it can be operated while tank 13 is still being worn. A sprayer valve 19 with a lever is connected along tube 14 and attached to handle 11 to control spraying, so that the solution can be sprayed where necessary, and only as much as necessary. Thus the solution can be spread more evenly and dried faster. Sprayer valve 19 is preferably offset about 90 degrees relative to nozzle 15 about the axis of handle 11 for easy reach while handle 11 is held in a diagonal position in front of the worker which is necessary for being moved in the figure "8" pattern.

Although the above description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. The mop can be used for applying other types of liquids. Therefore, the scope of the invention should be determined by the appended claims and their legal equivalents, not by the examples given.

I claim:

1. A mop for applying a liquid to a floor, comprising:

an elongated handle;

a resilient absorbent material connected to a lower end of said handle for absorbing and spreading said liquid;

a backpack tank for holding a supply of said liquid;

straps attached to said tank and enabling said tank to be carried on a worker;

a nozzle attached to said handle for applying said liquid on said floor;

a tube connected between said tank and said nozzle for delivering said liquid from said tank to said nozzle;

a manually operated pressurizing pump attached to said tank for pressurizing said tank; and a pivoting pump lever attached to said pump and movable up and down for manually operating said pump, said pump lever is positioned on a side of said tank and projecting forward for being within reach of said worker while said tank is being worn.

2. The mop of claim 1, wherein said absorbent material is comprised of a loose bundle of flexible rayon cords for absorbency and texture to avoid streaking.

3. A mop for applying a liquid to a floor, comprising:

an elongated handle;

a head less than about 10 inches across attached to a lower end of said handle for being movable in a figure "8" pattern;

a resilient absorbent material attached to said head for absorbing and spreading said liquid;

a backpack tank for holding a supply of said liquid;

straps attached to said tank and enabling said tank to be carried on a worker;

a nozzle attached to said handle outside said head for spraying said liquid on said floor;

a tube connected between said tank and said nozzle for delivering said liquid from said tank to said nozzle;

a manually operated pressurizing pump attached to said tank for pressurizing said tank; and a pivoting pump lever attached to said pump and movable up and down for manually operating said pump, said pump lever is positioned on a side of said tank and projecting forward for being within reach of said worker while said tank is being worn.

4. The mop of claim 3, wherein said absorbent material is comprised of a loose bundle of flexible rayon cords for absorbency and texture to avoid streaking.

5. A mop for applying a liquid to a floor, comprising:

an elongated handle;

a resilient absorbent material connected to a lower end of said handle for absorbing and spreading said liquid;

a backpack tank for holding a supply of said liquid;

straps attached to said tank and enabling said tank to be carried on a worker;

a nozzle attached to said handle outside said head for spraying said liquid on said floor;

a tube connected between said tank and said nozzle for delivering said liquid from said tank to said nozzle;

a manually operated pressurizing pump attached to said tank for pressurizing said tank;

a pivoting pump lever attached to said pump and movable up and down for manually operating said pump, said pump lever extending from a side of said tank and projecting forward for being within reach of said worker while said tank is being worn; and a sprayer valve connected along said tube and attached to an intermediate position below an upper end of said handle to control spraying, said sprayer valve is offset about 90 degrees relative to said nozzle about an axis of said handle for being reached while said handle is held in a diagonal position in front of said worker.

6. The mop of claim 5, wherein said absorbent material is comprised of a loose bundle of flexible rayon cords for absorbency and texture to avoid streaking.

* * * * *